US011206491B2

(12) United States Patent
Zhou

(10) Patent No.: US 11,206,491 B2
(45) Date of Patent: Dec. 21, 2021

(54) SPEAKER MODULE AND ELECTRONIC DEVICE

(71) Applicant: Goertek Inc., Shandong (CN)

(72) Inventor: Shuzhi Zhou, Weifang (CN)

(73) Assignee: Goertek Inc., Shandong (CN)

( * ) Notice: Subject to any disclaimer, the term of this patent is extended or adjusted under 35 U.S.C. 154(b) by 0 days.

(21) Appl. No.: 16/975,319

(22) PCT Filed: Dec. 24, 2018

(86) PCT No.: PCT/CN2018/123200

§ 371 (c)(1),
(2) Date: Aug. 24, 2020

(87) PCT Pub. No.: WO2019/161702

PCT Pub. Date: Aug. 29, 2019

(65) Prior Publication Data

US 2021/0037321 A1 Feb. 4, 2021

(30) Foreign Application Priority Data

Feb. 26, 2018 (CN) ..... 201810160278.3

(51) Int. Cl.

| | |
|---|---|
| ***G10K 11/16*** | (2006.01) |
| ***H04R 9/06*** | (2006.01) |
| ***H04R 9/02*** | (2006.01) |

(52) U.S. Cl.

CPC ..... *H04R 9/06* (2013.01); *H04R 9/02* (2013.01)

(58) Field of Classification Search

CPC ..... H04R 9/06; H04R 9/02
USPC ..... 381/71.1, 71.4
See application file for complete search history.

(56) References Cited

U.S. PATENT DOCUMENTS

2016/0014487 A1* 1/2016 Yang ..... H04R 1/2857 381/391
2018/0213319 A1* 7/2018 Qin ..... H04R 1/2857

* cited by examiner

*Primary Examiner* — Ammar T Hamid
(74) *Attorney, Agent, or Firm* — Baker Botts, LLP

(57) ABSTRACT

Provided in an embodiment of the present disclosure is a speaker module and an electronic device. The speaker comprises: a module housing, a speaker unit and sound-absorbing particles; wherein the speaker unit divides an inner cavity enclosed by the module housing into a front acoustic cavity and a rear acoustic cavity; the rear acoustic cavity is provided with a filling area separated out by a partition wall, and the filling area is provided with a port enabling air circulation; the sound-absorbing particles are filled in the filling area and are confined within the filling area; a gap is formed between the port of the filling area and an inner wall of the module housing, and sound-absorbing cotton is provided in the gap. The technical solution of the present disclosure can reduce influence of the resonance caused by the gap on acoustic performance of the speaker module.

9 Claims, 3 Drawing Sheets

SPEAKER MODULE AND ELECTRONIC DEVICE

CROSS-REFERENCE TO RELATED APPLICATIONS

This application is a National Stage of International Application No. PCT/CN2018/123200, filed on Jun. 1, 2017, which claims priority to Chinese Patent Application No. 201810160278.3, filed on Jun. 2, 2016, both of which are hereby incorporated by reference in their entireties.

TECHNICAL FIELD

The present disclosure relates to the technical field of electroacoustic conversion apparatuses, and in particular to a speaker module and an electronic device.

BACKGROUND

A speaker is a device that can convert electrical energy into sound energy, and is widely used in electronic devices such as mobile phones and computers. In the prior art, when a speaker is to be bonded with a terminal device, it is usually necessary to arrange a speaker unit in an external housing, and assemble it into the terminal device in a form of module.

In the prior art, a retaining wall is usually provided on a lower housing of the speaker, and a hot-melt mesh cloth is provided above the retaining wall to form a filling space for the sound-absorbing particles. In order to ensure that airflow can go through the mesh cloth to contact the sound-absorbing particles, a slit will be formed between the mesh cloth and the upper housing of the module. However, the existence of the slit is likely to cause resonance, thereby affecting acoustic performance of the speaker module.

SUMMARY

An object of the invention is to reduce influence of resonance caused by a gap on the acoustic performance of the speaker module.

According to one aspect of the invention, a speaker module is provided. The speaker module comprises a module housing, a speaker unit and sound-absorbing particles; wherein the speaker unit divides an inner cavity enclosed by the module housing into a front acoustic cavity and a rear acoustic cavity; the rear acoustic cavity is provided with a filling area separated out by a partition wall, and the filling area is provided with a port enabling air circulation; the sound-absorbing particles are filled in the filling area and are confined within the filling area; a gap is formed between the port of the filling area and an inner wall of the module housing, and sound-absorbing cotton is provided in the gap.

Optionally, the module housing comprises a first housing and a second housing covered on and connected with the first housing to form the inner cavity; the partition wall is provided on a bottom wall of the first housing located at the rear acoustic cavity; the partition wall extends toward the second housing, and the gap is left between the partition wall and the second housing.

Optionally, the partition wall is bonded with a separation net for sealing and covering the port of the filling area and providing airflow circulation, and the sound-absorbing cotton is located between the separation net and the second housing.

Optionally, the sound-absorbing cotton is bonded to the partition wall to seal and cover the port of the filling area.

Optionally, the sound-absorbing cotton is bonded to the partition wall by adhesion or thermal fusion.

Optionally, the sound-absorbing cotton is compressed and deformed in the gap by a squeezing force of the second housing.

Optionally, the sound-absorbing cotton is fixed on an inner surface of the second housing facing the port of the filling area, and the sound-absorbing cotton seals and covers the port of the filling area through an extrusion of the second housing and the partition wall.

Optionally, a filling opening is provided at a side, distal from the sound-absorbing cotton, of the module housing and on a housing wall directly facing the filling area, the filling opening being covered with a seal.

Optionally, the module housing is provided with a leak hole at a position directly facing the rear acoustic cavity, the leakage hole being covered with a damping.

According to another aspect of the invention, an electronic device is provided. The electronic device comprises the above speaker module.

In the technical solution provided by the embodiment of the present invention, a sound-absorbing cotton is provided in the gap between the port of the filling area of the sound-absorbing particles and the inner wall of the module housing. When the sound wave transmitted by the speaker unit enters the gap, the resonance wave generated due to the resonance will be absorbed by the sound-absorbing cotton in the gap, thereby effectively reducing the effect of resonance on the acoustic performance of the speaker module.

Other features and advantages of the invention will become clear from the following detailed description of exemplary embodiments of the invention with reference to the drawings.

BRIEF DESCRIPTION OF THE DRAWINGS

The drawings that form a part of the description describe embodiments of the invention, and together with the description serve to explain the principles of the invention.

DETAILED DESCRIPTION

Figure 1:
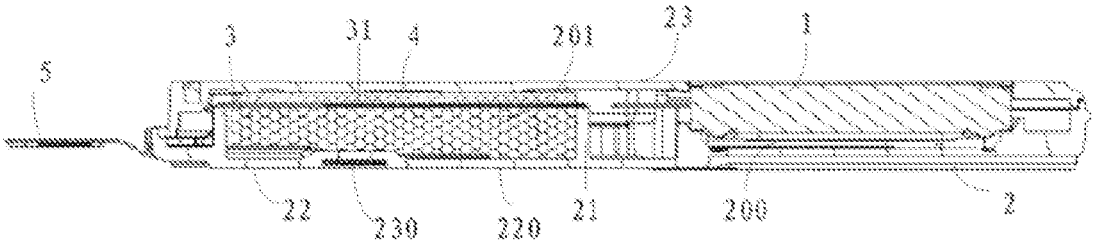
FIG. 1 is a cross sectional view of a speaker module provided by an embodiment of the present invention.

Various exemplary embodiments of the invention will now be described in detail with reference to the drawings. It should be noted that: unless specifically stated otherwise, the relative arrangement of components and steps, numerical expressions, and numerical values set forth in these embodiments do not limit the scope of the invention.

The following description of at least one exemplary embodiment is actually merely illustrative, and in no way serves as any limitation on the invention and its application or use.

Techniques and devices known to those of ordinary skill in the related art may not be discussed in detail, but where appropriate, the techniques and devices should be considered as part of the description.

In all examples shown and discussed herein, any specific values should be interpreted as exemplary only and not as limitations. Therefore, other examples of the exemplary embodiment may have different values.

It should be noted that: similar reference numerals and letters indicate similar items in the following drawings. Therefore, once an item is defined in one drawing, there is no need to discuss it further in subsequent drawings.

FIG. 1 is a cross sectional view of a speaker module provided by an embodiment of the present invention. As shown in FIG. 1, the speaker module comprises a module housing 2, a speaker unit 1 and sound-absorbing particles 3; wherein the speaker unit 1 divides an inner cavity enclosed by the module housing 2 into a front acoustic cavity 200 and a rear acoustic cavity 201; the rear acoustic cavity 201 is provided with a filling area separated out by a partition wall 21, and the filling area is provided with a port enabling air circulation; the sound-absorbing particles 3 are filled in the filling area and are confined within the filling area; a gap is formed between the port of the filling area and an inner wall of the module housing 2, and sound-absorbing cotton 4 is provided in the gap.

Since the sound-absorbing particles have a sound-absorbing effect, setting the sound-absorbing particles in the rear acoustic cavity is equivalent to increasing the air flow space in the rear acoustic cavity, which can effectively improve the low frequency response and improve the acoustic performance.

The above-mentioned gap is a slit designed in advance for achieving contact between the airflow in the rear acoustic cavity 201 and the sound-absorbing particles 3.

As we all know, once a sound wave enters a narrow space, it is easy for resonance phenomena to occur and generate a resonance wave, thereby affecting the acoustic performance of the speaker module.

In the technical solution provided by the embodiment of the present invention, a sound-absorbing cotton is provided in the gap between the port of the filling area of the sound-absorbing particles and the inner wall of the module housing. When a sound wave transmitted from the speaker unit enters the gap, the resonance wave generated by the resonance will be absorbed by the sound-absorbing cotton in the gap, thereby effectively reducing the degree of influence of resonance on the acoustic performance of the speaker module.

In an achievable solution, the above gap is fully filled with the sound-absorbing cotton 4, so that the resonance waves generated in the gap by the sound waves are all absorbed as much as possible, improving the acoustic performance of the speaker.

Figure 2:
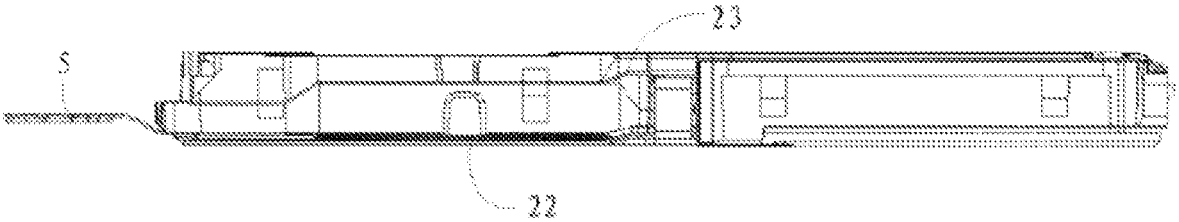
FIG. 2 is a schematic structural view of a speaker module according to an embodiment of the present invention in a first direction perspective.

Further, as shown in FIGS. 1 and 2, the module housing 2 comprises a first housing 22 and a second housing 23 covered on and connected with the first housing 22 to form the inner cavity; the partition wall 21 is provided on a bottom wall 220 of the first housing 22 located at the rear acoustic cavity 201; the partition wall 21 extends toward the second housing 23, and the gap is left between the partition wall and the second housing 23. The purpose of setting the gap is to ensure that the sound-absorbing particles 3 in the filling area can fully contact with the airflow in the rear acoustic cavity 201, so as to improve the expansion ratio of the sound-absorbing particles. For example, the partition wall 21 may be a surrounding wall extending from the bottom wall 220 to the second housing 23; the surrounding wall and the bottom wall 220 together form a filling area.

Specifically, the second housing 23 and the first housing 22 may be connected by an adhesive or glue. Of course, ultrasonic welding may also be used to achieve the connection between the first housing 22 and the first housing 22.

One or more of the following methods can be used to limit the sound-absorbing particles 3 to the filling area:

Solution One: a separation net sealing method can be used. Specifically, as shown in FIG. 1, the partition wall 21 is bonded with a separation net 31 for sealing and covering the port of the filling area and providing airflow circulation, and the sound-absorbing cotton 4 is located between the separation net 31 and the second housing 23. The above gap exists between the separation net 31 and the inner wall of the second housing 23, and the sound-absorbing cotton 4 is provided in the gap.

When the partition wall is the above-mentioned surrounding wall structure, the separation net 31 can be sealed at the end of the surrounding wall to limit the sound-absorbing particles in the filling area and prevent the sound-absorbing particles from leaking into the magnetic circuit system in the speaker unit.

The separation net 31 includes, but is not limited to; mesh cloth, sound-absorbing cotton, metal corrosion-resistant net, and the like. The existence of the air holes on the separation net 31 realizes the contact between the airflow in the rear acoustic cavity 201 and the sound-absorbing particles in the filling area. The separation net 31 is bonded to the partition wall 21 by adhesion or thermal fusion.

Solution Two: the sound-absorbing cotton 4 can be used directly to limit the sound-absorbing particles 3 in the filling area. Specifically, the sound-absorbing cotton 4 is bonded to the partition wall 21 to seal and cover the port of the filling area. As shown in FIG. 1, one side of the sound-absorbing cotton 4 is fitted to the sound-absorbing particles 3, and the other side is fitted to the inner wall of the second housing 23, wherein the sound-absorbing cotton 4 may be bonded to the partition wall 21 by adhesion or thermal fusion, thus limiting the sound-absorbing particles in the filling area. In this embodiment, the sound-absorbing cotton not only eliminates the resonance, but also replaces the separation net to play a sealing role, effectively saving costs and optimizing the process.

When the partition wall 21 is the above-mentioned surrounding wall structure, the sound-absorbing cotton 4 can be sealed and covered at the end of the surrounding wall to limit the sound-absorbing particles in the filling area and prevent the sound-absorbing particles from leaking into the magnetic circuit system in the speaker unit.

Solution Three: the sound-absorbing cotton 4 is fixed on an inner surface of the second housing 23 facing the port of the filling area, and the sound-absorbing cotton 4 seals and covers the port of the filling area through an extrusion of the second housing 23 and the partition wall 21. In this solution, the sound-absorbing cotton 4 can be fixed on the inner surface of the second housing 23 by thermal fusion or adhesive.

Further, in the above solution one and solution two, the sound-absorbing cotton 4 is compressed and deformed in the gap by a squeezing force of the second housing 23. In this way, the sound-absorbing cotton 4 and the inner surface of the second housing 23 can be closely adhered to avoid forming a gap between the sound-absorbing cotton 4 and the inner surface of the second housing 23, and to improve the firmness of the sound-absorbing cotton.

The sound-absorbing particles can be filled in the following ways:

Method One: before connecting the first housing 22 and the second housing 23, the sound-absorbing particles 4 may be filled into the filling area, and then sealed and covered by using a separation net or sound-absorbing cotton.

Method Two: a filling opening is provided on the module housing, and the sound-absorbing particles are filled through the filling opening after the module is assembled.

Figure 3:
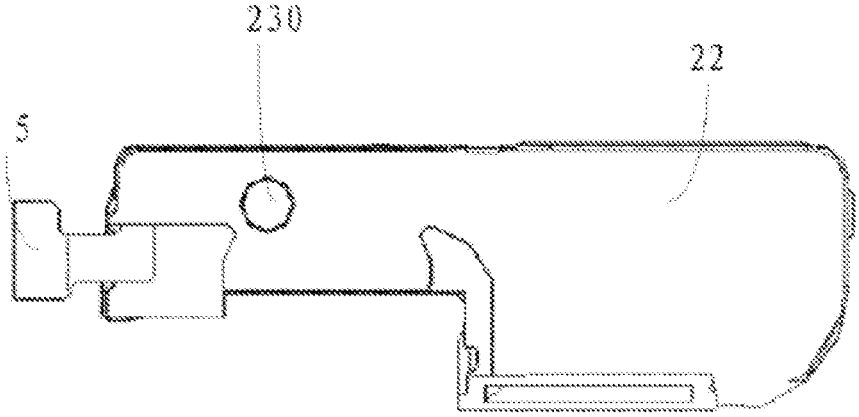
FIG. 3 is a schematic structural view of a speaker module according to an embodiment of the present invention in a second direction perspective.
Figure 6:
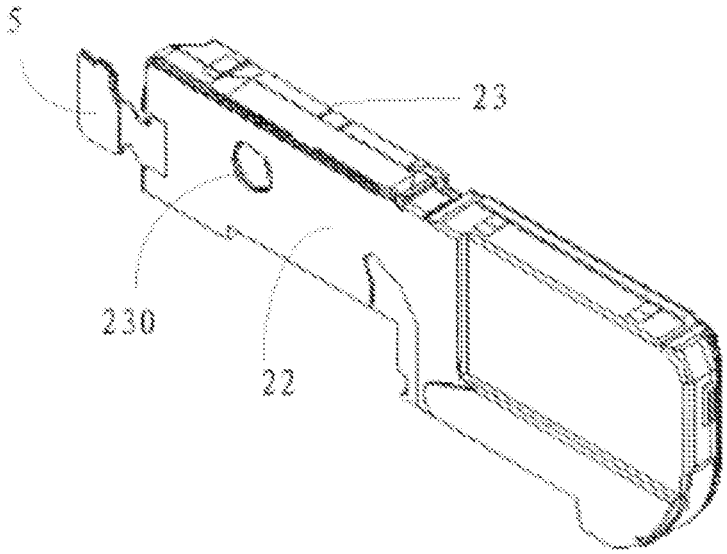
FIG. 6 is a schematic structural view of a speaker module according to an embodiment of the present invention in a fourth direction perspective.

In the above method two, it can be specifically achieved by the following ways: as shown in FIGS. 3 and 6, a filling opening is provided at a side, distal from the sound-absorbing cotton 4, of the module housing 2 and on a housing wall directly facing the filling area, the filling opening being covered with a seal 230. It is more convenient to fill the sound-absorbing particles 3 through the filling opening. After the filling is completed, the seal 230 is used to seal to avoid leakage of the sound-absorbing particles 3. For example, as shown in FIG. 1, the filling opening is provided on the first housing 22 at a position facing the filling area. The material of the seal 230 includes, but is not limited to, PET (Polyethylene terephthalate).

Figure 4:
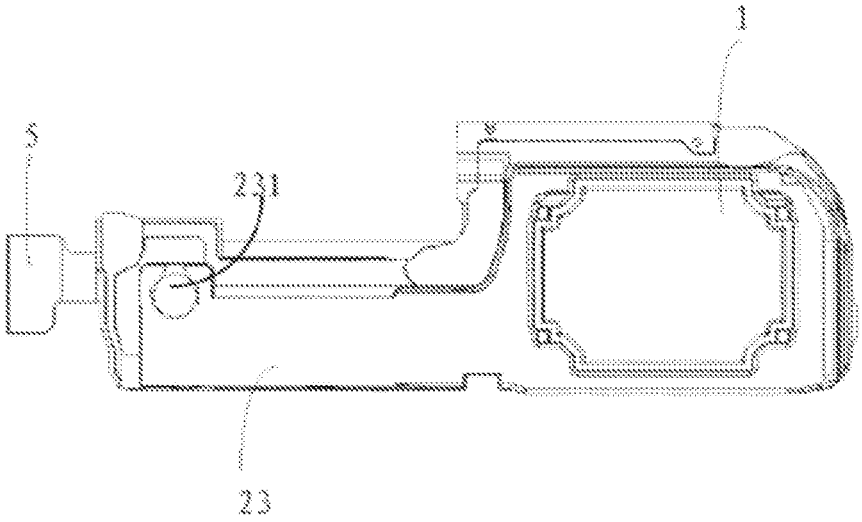
FIG. 4 is a schematic structural view of a speaker module according to an embodiment of the present invention in a third direction perspective.
Figure 5:
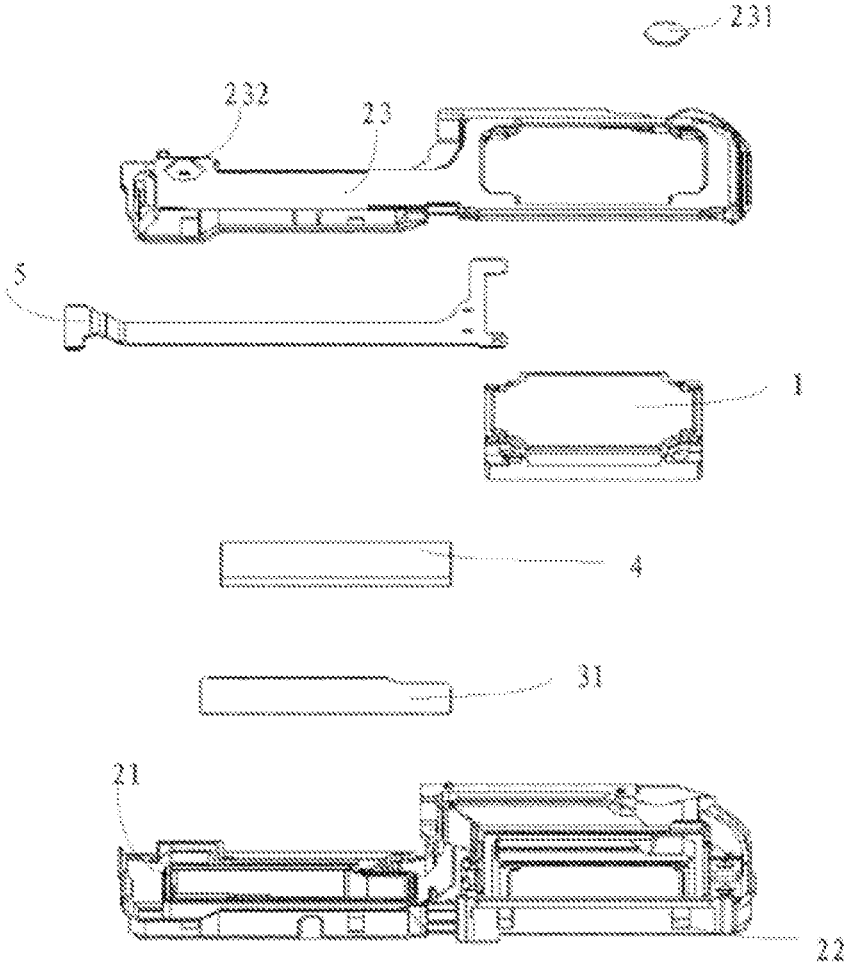
FIG. 5 is an exploded view of a speaker module provided by an embodiment of the present invention.
Figure 7:
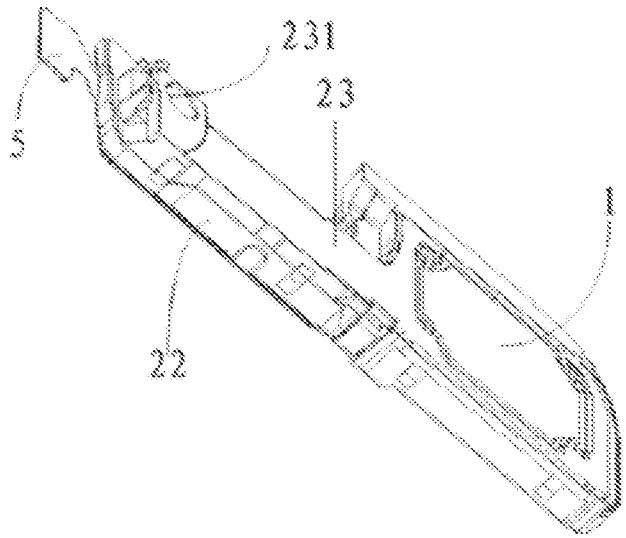
FIG. 7 is a schematic structural view of a speaker module according to an embodiment of the present invention in a fifth direction perspective.

Further, as shown in FIGS. 4, 5 and 7, the module housing 2 is provided with a leak hole 232 at a position directly facing the rear acoustic cavity 201, the leakage hole 232 being covered with a damping 231. Since the air in the rear acoustic cavity 201 will be compressed or expanded, the leakage hole 232 is provided on the module housing 2 to facilitate the circulation of air to balance the air pressure inside and outside the speaker module. Covering the damping 231 at the leak hole 232 can increase the acoustic resistance of the leak hole to reduce the influence of the leak hole on the acoustic performance. The damping 231 includes, but is not limited to, mesh cloth.

Generally, the speaker unit 1 in the speaker module needs to be electrically connected to an external circuit through a connection circuit, for example, to an external power supply circuit. In an achievable solution, as shown in FIGS. 4 and 5, the above speaker module further includes: a flexible circuit board 5; one end of the flexible circuit board 5 extends into the module housing 2 and is electrically connected to the speaker unit 1, and the other end extends out of the module housing 2. The external circuit realizes an electrical connection with the speaker unit 1 through an end extending out of the module housing 2.

The above speaker module may be a side sound speaker module or a front sound speaker module. In practical applications, in order to improve the intermediate frequency characteristic or to achieve thinner and thinner products such as for the mobile phones, the speaker module is generally in a side sound mode.

According to another aspect of the present invention, there is also provided an electronic device including a speaker module, wherein, for the specific implementation of the speaker module, reference may be made to the related contents in the foregoing embodiments, and details are not repeated here.

Specifically, as shown in FIG. 1, the speaker module comprises a module housing 2, a speaker unit 1 and sound-absorbing particles 3; wherein the speaker unit 1 divides an inner cavity enclosed by the module housing 2 into a front acoustic cavity 200 and a rear acoustic cavity 201; the rear acoustic cavity 201 is provided with a filling area separated out by a partition wall 21; the sound-absorbing particles 3 are filled in the filling area and are confined within the filling area; a gap is formed between the sound-absorbing particles 3 and an inner wall of the module housing 2, and sound-absorbing cotton 4 is provided in the gap.

The electronic device includes, but is not limited to, mobile phone, tablet computer, MP3, etc.

Although some specific embodiments of the invention have been demonstrated in detail by way of examples, it should be understood by a person skilled in the art that the above examples are only intended to be illustrative but not to limit the scope of the invention. It should be understood by a person skilled in the art that the above embodiments can be modified without departing from the scope and spirit of the present invention. The scope of the present invention is defined by the attached claims.

The invention claimed is:

1. A speaker module, comprising a module housing, a speaker unit and sound-absorbing particles;

wherein the speaker unit divides an inner cavity enclosed by the module housing into a front acoustic cavity and a rear acoustic cavity;

the rear acoustic cavity is provided with a filling area separated out by a partition wall, and the filling area is provided with a port for air circulation;

the sound-absorbing particles are positioned and confined within the filling area;

a gap is formed between the port of the filling area and an inner wall of the module housing, and a sound-absorbing cotton is provided in the gap, wherein the module housing comprises a first housing and a second housing covered on and connected with the first housing to form the inner cavity, wherein the partition wall is provided on a bottom wall of the first housing located at the rear acoustic cavity, wherein the partition wall extends toward the second housing, and the gap is left between the partition wall and the second housing.

2. The speaker module according to claim 1, wherein the partition wall is bonded with a separation net for sealing and covering the port of the filling area and providing airflow circulation, and the sound-absorbing cotton is located between the separation net and the second housing.

3. The speaker module according to claim 1, wherein the sound-absorbing cotton is bonded to the partition wall to seal and cover the port of the filling area.

4. The speaker module according to claim 3, wherein the sound-absorbing cotton is bonded to the partition wall by adhesion or thermal fusion.

5. The speaker module according to claim 2, wherein the sound-absorbing cotton is compressed and deformed in the gap by a squeezing force of the second housing.

6. The speaker module according to claim, 1 wherein the sound-absorbing cotton is fixed on an inner surface of the second housing facing the port of the filling area, and the sound-absorbing cotton seals and covers the port of the filling area through an extrusion of the second housing and the partition wall.

7. The speaker module according to claim 1, wherein a filling opening is provided at a side, distal from the sound-absorbing cotton, of the module housing and on a housing wall directly facing the filling area, the filling opening being covered with a seal.

8. The speaker module according to claim 1, wherein the module housing is provided with a leak hole at a position directly facing the rear acoustic cavity, the leakage hole being covered with a damping.

9. An electronic device, comprising the speaker module according to claim 1.

* * * * *